United States Patent [19]

Riddiford

[11] Patent Number: 4,519,453

[45] Date of Patent: May 28, 1985

[54] IGNITION SYSTEM

[75] Inventor: Frederick A. Riddiford, Chertsey, England

[73] Assignee: The British Petroleum Company p.l.c., London, England

[21] Appl. No.: 402,540

[22] Filed: Jul. 28, 1982

[30] Foreign Application Priority Data

Aug. 1, 1981 [GB] United Kingdom ..... 8123620

[51] Int. Cl.[3] ..... E21B 36/02

[52] U.S. Cl. ..... 166/303; 175/14; 431/242

[58] Field of Search ..... 166/303, 302, 59; 175/14; 431/1, 4, 158, 242; 60/39.05, 39.06, 39.76, 39.77, 247, 249

[56] References Cited

U.S. PATENT DOCUMENTS

| | | | |
|---|---|---|---|
| 2,882,017 | 4/1959 | Napiorski | 175/14 |
| 3,616,857 | 11/1971 | Pitkethly et al. | 166/299 |
| 3,635,293 | 1/1972 | Desty et al. | 175/4.5 |
| 3,674,409 | 7/1972 | Desty et al. . | |
| 4,078,613 | 3/1978 | Hamrick et al. | 166/303 X |
| 4,243,098 | 12/1981 | Meeks et al. | 166/59 |
| 4,366,860 | 1/1983 | Donaldson et al. | 166/303 X |

*Primary Examiner*—Stephen J. Novosad
*Assistant Examiner*—Thuy M. Bui
*Attorney, Agent, or Firm*—Morgan, Finnegan, Pine, Foley & Lee

[57] ABSTRACT

A burner having a pulsating mode of operation has a combustion chamber for the periodic burning of successive separate charges of combustible fuel continuously supplied from an inlet system. Upstream of the combustion chamber is an ignition chamber having roughened internal walls, an ignition source and an inlet system for fuel and oxygen. During use of the burner, periodic ignition of successive separate charges of combustible gas in the ignition chamber produces fast moving combustion or detonation waves capable of igniting the successive separate charges of combustible fuel in the combustion chamber.

15 Claims, 4 Drawing Figures

Figure 2A:
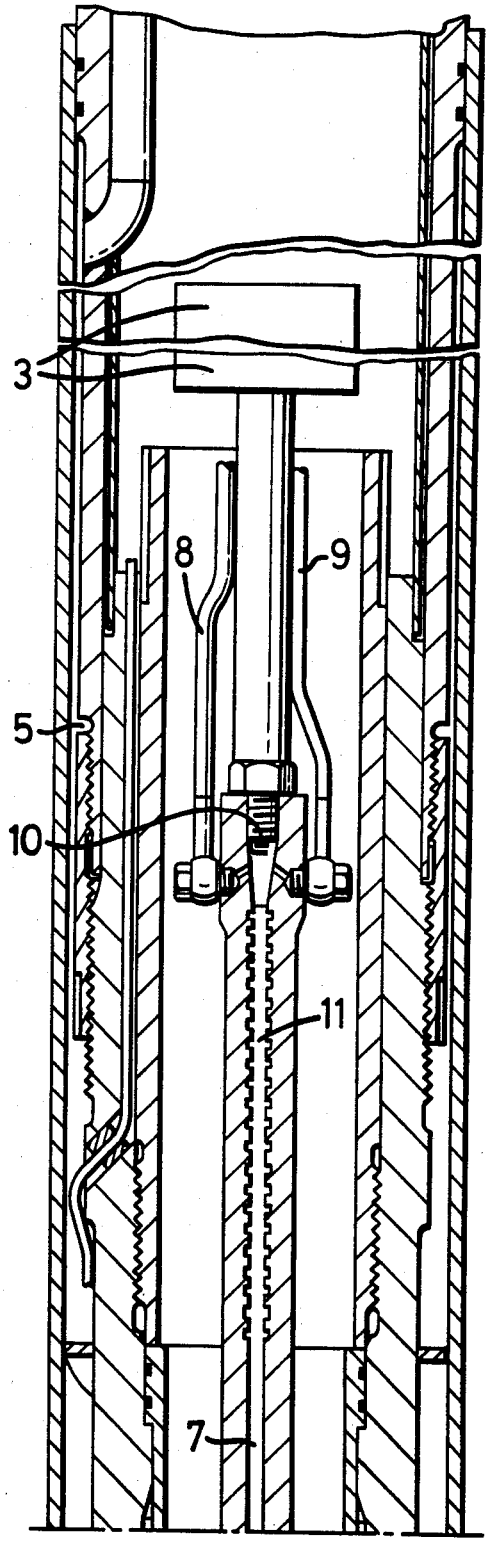

FIG.1A
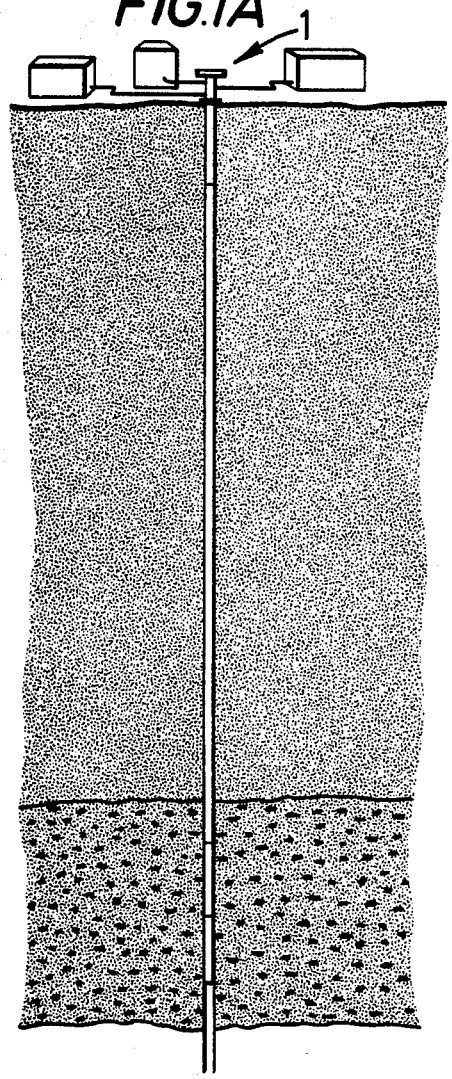
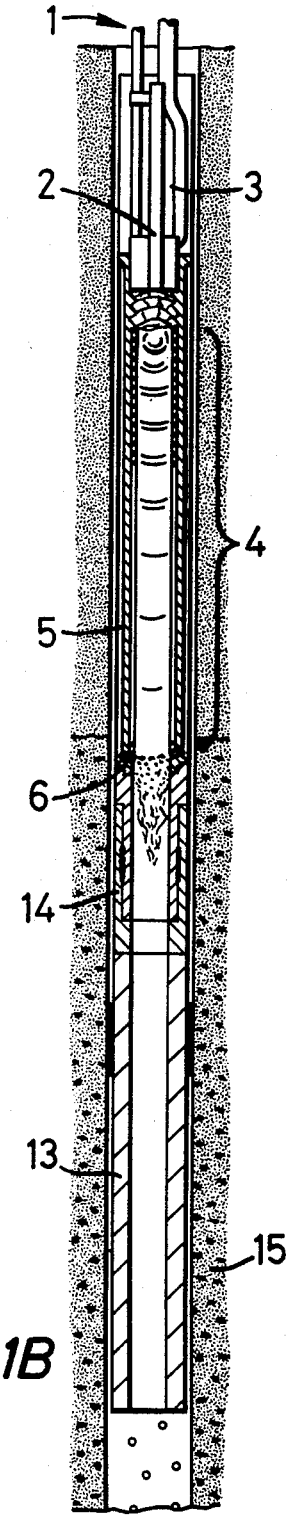
FIG.1B

IGNITION SYSTEM

The present invention relates to ignition systems and more particularly to ignition systems for pulsating burners.

Interest in thermal recovery techniques for the recovery of viscous crude oils, the possibility of in-situ coal conversion, etc., has led to interest in burners capable of operating in strata at depths of down to several thousand feet.

A burner suitable for operation at these depths is described in UK Patent Nos. 1254452 and 1254453. The burner has a pulsating mode of operation and comprises a combustion chamber having grossly rough internal walls and a gaseous oxygen/fuel inlet system which has a low resistance to gaseous flow and which is arranged to mix the fuel and oxygen at one end of the combustion chamber, whereby, during use of the burner, a series of explosion waves is produced by repeated ignition of an explosive mixture fed into the combustion chamber.

At pressures of the order of atmospheric pressure, ignition of the burner is relatively straightforward and conventional low voltage techniques may be used. However, at the higher pressures experienced in down hole strata which may be of the order 200 bar and using less volatile fuels, conventional spark ignition techniques may be unsuitable because of failure to give required duration and performance reliability. Also recovery of the down hole equipment for repair or maintenance of the ignition system is an inconvenience apart from the extra cost involved. The present invention relates to an improved ignition system suitable for use with a burner have a pulsating mode of operation.

Thus according to the present invention there is provided a burner having a pulsating mode of operation comprising a combustion chamber for the periodic burning of successive separate charges of combustible fuel continuously applied to the combustion chamber, an inlet system for fuel and an oxygen containing gas for continuously supplying the combustible fuel to the combustion chamber and a further chamber having at least partly roughened internal walls connected to and upstream of the combustion chamber, the further chamber having an ignition source and an inlet system to fuel and an oxygen containing gas whereby, during use of the burner, periodic ignition of successive separate charges of combustible gas in the further chamber produces fast moving combustion or detonation waves capable of igniting the successive separate charges of combustible fuel in the combustion chamber.

The igniter may, for example, be a conventional spark plug, a semi conductor plug or plasma jet spark plug. The construction and operation of plasma jet spark igniters are described in GB Pat. No. 1310499, U.S. Pat. Nos. 3,842,818, 3,842,819 and 3,911,307.

The combustible fuel for the further or ignition chamber is preferably hydrogen and most preferably is produced by passing hydrogen and air into a mixing head which is adjacent to the igniter.

The further or ignition chamber having roughened internal walls is preferably in the form of a long tube. The internal walls may be roughened in several ways. Thus, for example, a spiral of rod, preferably metal, may be secured to the internal wall of the chamber, the walls may have grooves formed in them or a random roughness may be imposed on the internal walls. The chamber may have partly roughened walls, the roughened area preferably being adjacent to the igniter.

The length of the chamber is tailored to give a combustion or detonation wave of suitable combustion performance and ignition energy, for example of the order of 2000 meters/sec compatible with reliable ignition of the fuel oxygen mixture in the main combustion chamber. The wide operating range of the ignition chamber is of particular importance as the burner having a pulsating mode of operation is designed to run on a wide range of fuels, each fuel having differing ignition energy requirements. Thus a wave of greater energy is required to ignite as methane/air mixture then a hydrogen/air mixture.

Also liquid fuels can be used in the main fuel chamber and are preferably introduced by use of an atomiser.

Preferably the outlet of the chamber to the main combustion chamber is flared in cross section so as to allow improved ignition coupling between the fast moving combustion or detonation wave and the main combustion chamber.

In down hole applications, such as a down hole steam generation it is very important that ignition of the components of the main combustion chamber occurs reliably as otherwise explosive quantities of gaseous mixture can build up. The present system by producing a reliable and powerful combustion or detonation wave in the chamber facilitates this objective.

The invention also includes a down hole heater comprising a burner having a pulsating mode of operation as hereinbefore described. With the ignition system as hereinbefore described, the burner having a pulsating mode of operation does not necessarily require a combustion chamber whose walls are roughened and smooth combustion chamber walls or only partly roughened walls may be suitable under certain ignition conditions.

The invention further includes a down hole steam generator comprising a burner having a pulsating mode of operation, an ignition system as hereinbefore described and means for spraying or dispersing water into the exhaust gases from the combustion chamber of said burner to thereby form a steam/exhaust gas mixture.

The invention will now be described by way of example only and with reference to the accompanying drawings.

FIGS. 1(*a*) and 1(*b*) show a vertical section of a down hole steam generator located in operational position.

Figure 2B:
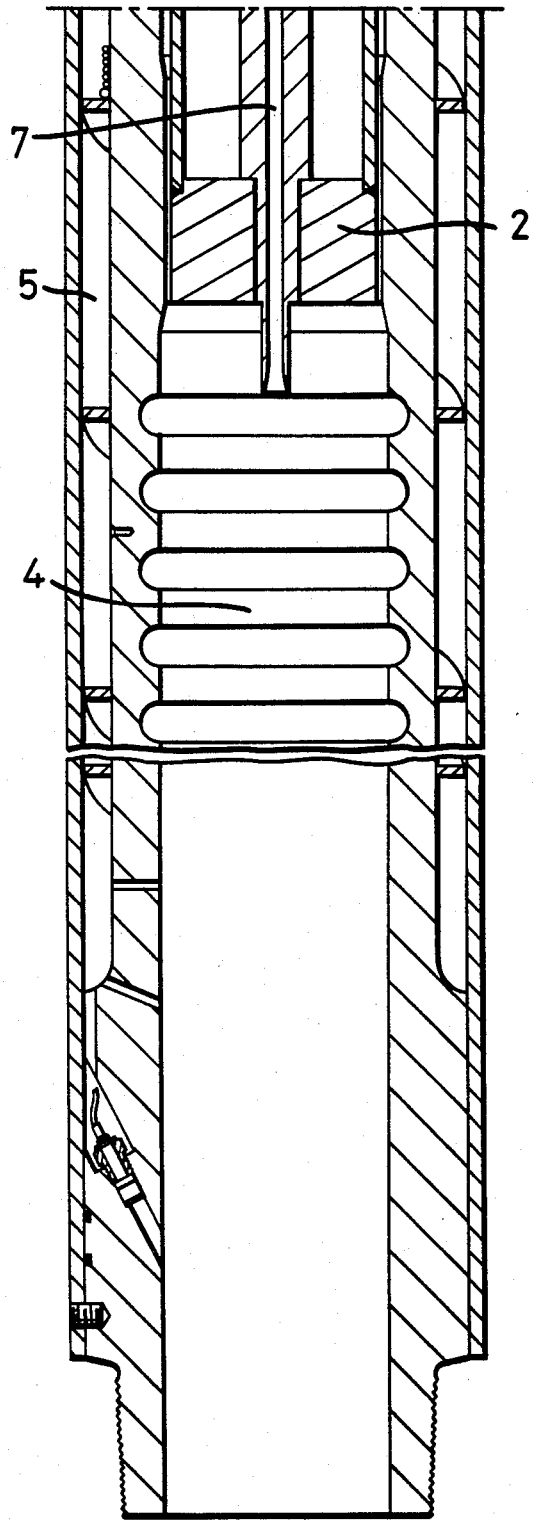

FIGS. 2(*a*) and 2(*b*) show a schematic diagram of an ignition system and mixing head which is partially in vertical section, In FIG. 1, the layout of steam generator in position down a bore hole is shown. The fuel, power, and water air supplies 1 are at the surface and are fed to the mixing head 2 and ignition system 3 by means of pipes. The fuel, water, oxygen supplies 1 are pre-heated if necessary. The mixing head 2 and ignition system 3 are connected to the main combustion chamber 4 of the pulsating burner. The mixing head 2 and combustion chamber 4 are surrounded by a water jacket 5 fed from the surface, the water jacket 5 having an outlet to a spray head 6 downstream of the combustion chamber 4. Downstream of the combustion chamber and the spray head a packer 13 linked to the chamber by a connecting union 14 extends to the working steam area. The packer 13 serves to locate and seal the combustion chamber in the well casing.

The mixing head and ignition system is shown in FIG. 2. Hydrogen and air are supplied to the detonation tube or chamber 7 near to the working end of the electrical initiator 10 through pipes 8,9. The detonation tube or chamber 7 is downstream of the electrical initiator 10. The internal walls of the ignition tube or chamber 7 have a spiral groove cut in the metal to provide the internal roughness so that the combustion wave initiated by the spark accelerates into a fast moving combustion or a detonation wave. Downstream of the detonation tube or chamber 7 is the main combustion chamber 4 which is supplied with fuel, such as gas oil or kerosene, and air from a mixing head 2. The internal combustion chamber walls have an initial roughened portion leading to a smooth remaining portion.

In use, the steam generator is positioned down the bore hole. Hydrogen and air are supplied from pipes 8,9 to the detonation tube or chamber 7 near the working end of the electrical initiator 10. An electrical discharge causes a combustion wave to be generated in the detonation tube or chamber 7 which is caused by the roughened walls 11 of the chamber 7 to accelerate into a fast moving combustion wave or a detonation wave. This detonation wave causes ignition of the main fuel/air system in the combustion chamber 4 supplied via the mixing head 12. In this way it is believed that a relatively low energy electrical discharge (of the order 0.01 to 1.0 Joules) is increased to a high energy event (of the order 100 to 500 Joules) by the detonation wave initiated in the detonation tube. The main fuel/air system is then regulated to give pulsating combustion. Water is pumped from a water spray head 6 connected to the water jacket 5 to create a steam/exhaust gas mixture which is fed to the surrounding rock formation 15 through the packer 13.

Electrical initiation of the ignition tube can be with plasma jet spark plug, semi conductor plug, conventional spark plug or other electrical means. It is also envisaged that more than one detonation tube may be used to give pulsed combustion. For example, multiple detonation tubes may be angled into the combustion chamber.

I claim:

1. A method of igniting a burner having a combustion chamber and a further chamber comprising the steps of (a) continuously supplying successive separate charges of combustible gas to the combustion chamber of the burner (b) continuously supplying successive separate charges of combustible gas to the further chamber of the burner (c) periodically igniting the combustible gas in the further chamber by actuation of the ignition source whereby fast moving combustion or detonation waves pass from the further chamber to the combustion chamber and ignite the combustible fuel in the combustion chamber.

2. A method of down hole steam generation using a burner having a combustion chamber and a further chamber comprising the steps of (a) continuously supplying successive separate charges of combustible gas to the combustion chamber of the burner (b) continuously supplying successive separate charge of combustible gas to the further chamber of the burner (c) periodically igniting the combustible gas in the further chamber by actuation of the ignition source whereby fast moving combustion or detonation waves pass from the further chamber to the combustion chamger and ignite the combustible gas in the combustion chamber, (d) spraying or dispersing water into the exhaust gases from the combustion chamber to thereby for a steam/exhaust gas mixture and (e) passing the steam/exhaust gas mixture into a geological formation.

3. A burner having a pulsating mode of operation comprising:

(a) a combustion chamber for the timed periodic explosive burning of successive separate charges of an explosive oxygen/fuel mixture continuously supplied to said burner;

(b) An oxygen/fuel inlet system for continuously supplying oxygen and fuel to the burner at one end of the combustion chamber, which system has a low resistance to gaseous flow and which is arranged to mix the fuel and the oxygen at said one end of the combustion chamber so as continuously to provide successive separate explosive mixture charges in said chamber, and;

(c) an ignition source for initiating, at selected periodic intervals, ignition of the continuously provided successive separate explosive mixture charges in said chamber said ignition source comprising a further chamber having at least partly roughened walls connected to and upstream of the combustion chamber, there being an igniter at one end of said further chamber whereby, during use of the burner, periodic ignition of successive separate charges of combustible gas in the further chamber produces fast moving combustion or detonation waves through an outlet in said further chamber capable of igniting the successive separate charges of combustible fuel in the combustion chamber.

4. A burner according to claim 3 in which the internal walls of the combustion chamber are at least partly roughened.

5. A burner according to claim 3 or claim 4 in which the partly roughened walls of the further chamber are adjacent to the ignition source.

6. A burner according to claim 3 or claim 4 in which the further chamber comprises a long cylindrical tube.

7. A burner according to claim 3 or claim 4 in which the ignition source is a spark plug, a plasma jet spark plug or an aircraft igniter of the semi-conductor type.

8. A burner according to claim 3 or claim 4 in which a plurality of further chambers are connected to a single combustion chamber.

9. A burner according to claim 3 or claim 4 in which the fuel supplied to the combustion chamber in methane, propane, gas oil or kerosene.

10. A burner according to claim 3 or claim 4 in which the fuel supplied to the further chamber is hydrogen.

11. A burner according to claim 3 or claim 4 in which the outlet of the further chamber to the combustion chamber is flared in crosssection.

12. A burner according to claim 3 or claim 4 and having means for spraying or dispersing water into the exhaust gases from the combustion chamber of the burner to thereby form a steam/exhaust gas mixture.

13. A burner according to claim 3 or 4 in which the internal walls are roughened by having a spiral of rod fabricated from metal secured to the internal wall of the chamber.

14. A burner according to claim 3 or 4 and having means for spraying or dispersing water into the exhaust gases from the combustion chamber of the burner to thereby form a steam/exhaust gas mixture, said means for spraying or dispersing water being connected to a water jacket around the outside of the combustion chamber.

15. A burner according to claim 3 or claim 4 in which the internal walls are roughened by having a spiral of rod secured to the internal wall of the chamber.

* * * * *

UNITED STATES PATENT AND TRADEMARK OFFICE

CERTIFICATE OF CORRECTION

PATENT NO. : 4,519,453

DATED : May 28, 1985

INVENTOR(S) : FREDERICK A. RIDDIFORD

It is certified that error appears in the above-identified patent and that said Letters Patent is hereby corrected as shown below:

Column 1, line 34, "have" should read --having--.

Column 3, line 26, "12" should be --2--.

Column 3, last line of claim 2, "for" should read --form--.

Column 1, line 40, "applied" should read --supplied--.

Signed and Sealed this

*Eighth* Day of *October 1985*

[SEAL]

*Attest:*

DONALD J. QUIGG

*Attesting Officer*

*Commissioner of Patents and Trademarks—Designate*